United States Patent [19]

Applebaum et al.

[11] 4,283,871

[45] Aug. 18, 1981

[54] PANORAMIC PHOTOGRAPH ALBUM, AND METHOD FOR MAKING THE SAME

[76] Inventors: Melvin Applebaum, 75-03 192nd St., Flushing, N.Y. 11366; Len De Pas, 85-50 Forest Pkwy., Woodhaven, N.Y. 11421; William C. Little, 2001 McGraw Ave., Bronx, N.Y. 10462

[21] Appl. No.: 24,502

[22] Filed: Mar. 28, 1979

Related U.S. Application Data

[62] Division of Ser. No. 797,829, May 17, 1977, Pat. No. 4,183,162.

[51] Int. Cl.[3] ..... G09F 1/10

[52] U.S. Cl. ..... 40/158 R

[58] Field of Search ..... 40/530, 158; 281/15 R, 281/21 R, 40

[56] References Cited

U.S. PATENT DOCUMENTS

| | | | |
|---|---|---|---|
| 528,340 | 10/1894 | Palmer | 281/24 |
| 649,061 | 5/1900 | Leechman | 281/40 |
| 1,897,839 | 2/1933 | Gale | 281/40 |
| 1,992,618 | 2/1935 | Jeffrey | 281/40 |
| 3,061,850 | 11/1962 | Curtis | 281/15 R |
| 4,073,510 | 2/1978 | Scharlin | 281/15 R |

*Primary Examiner*—Gene Mancene
*Assistant Examiner*—Wenceslao J. Contreras
*Attorney, Agent, or Firm*—Bacon & Thomas

[57] ABSTRACT

A panoramic picture is taken to produce a negative with a panoramic image thereon, and a panoramic print is then made on a single sheet of double-wide photographic paper. The print is cut into two equal panels along a cutting line extending at right angles to the longitudinal axis of the print, and hinge members are fastened to the rear of the two panels along the cut edges. The hinge members are then secured in an album to mount the two picture panels in aligned, side-by-side relationship, with a narrow gap therebetween to prevent damage during closing and opening of the album. The hinge elements have a color tone corresponding to the general color tone of the central portion on the picture, to minimize the visibility of the gap. A triple-wide picture can also be made, which is divided into three panels, with the third panel being connected to the second by a hinge element.

4 Claims, 6 Drawing Figures

PANORAMIC PHOTOGRAPH ALBUM, AND METHOD FOR MAKING THE SAME

This is a division, of application Ser. No. 797,829, filed May 17, 1977, now U.S. Pat. No. 4,183,162.

BACKGROUND OF THE INVENTION

1. Field of the Invention

The present invention relates generally to photograph albums. More particularly, it relates to an improved album construction for displaying panoramic photographs, and a method for making the same.

2. Description of the Prior Art

When photographs are taken at weddings and like occasions, it is common practice for the photographer to supply such to the client mounted in an album designed for easy display of the photographs, and convenient, safe storage. There have been a number of different album constructions proposed for this purpose.

The usual practice is for all of the photographs in the album to be of the same size, say 8" by 10", and indeed the construction of the average album requires that the photographs not exceed certain maximum dimensions. Thus, the photographer is normally confined to making all photographic prints so they conform to a common size.

There are instances, however, when the subject matter of the photograph does not lend itself well to a standard size print. This is especially true when a picture is taken of a lengthy receiving line, or a lengthy object or scene. In these instances the picture must be reduced in size to accommodate the length of the object or scene to the normal width of the paper. This often results in reducing the image to a very small size, and in having a disproportionate amount of open space at the top and the bottom of the photographic print.

A better procedure would be to print such photographs in a panoramic manner, so that the resultant print appears in better proportions and presents the image in an acceptable size. However, it is not now possible to fit such a panoramic print into the average photograph album, without folding it and causing damage.

There is need for an arrangement and method for mounting a panoramic photograph on the facing pages of an album, so that double-wide or even triple-wide photographs can be properly displayed without damage. The present invention is intended to solve this need.

SUMMARY OF THE INVENTION

In the present invention the photographer first takes a panoramic picture, to produce a negative with a panoramic image thereon. A print is then made of the negative on a single sheet of double-wide photographic paper, or even triple-wide, if the picture so requires.

When the picture is double-wide, it is first cut into two panels of equal size, along a central cutting line that extends at a right angle to the longitudinal, horizontal axis of the picture. A flexible hinge member is then fastened to the backside of each portion of the panoramic picture, along the cut edge of the panel. The hinge members are then secured at their inner ends to the binding edge of an album, to mount the two panels in side-by-side aligned relationship as facing pages of the album.

In order to ensure that he cut edges of the picture panels will not be damaged during opening and closing of the album, it has been found that a narrow gap must be provided between the edges, say about ⅛ of an inch. The hinge members are fastened and secured to ensure the presence of this gap.

In order to assure that this necessary gap in the center of the double-wide panoramic scene does not disrupt the asthetic appearance of the picture, the invention proposes that the hinge members be made of material having a color tone generally like the color tone in the central portion of the photograph. That is, if the central portion of the photograph is dark in tone, the hinge members should also be dark in tone. Further, the photographer should take the picture so that the central portion thereof is filled with objects of varying tones, which contributes to making the gap between the mating, cut edges less noticeable.

If the photographic print is triple-wide, then the print is cut into three equal panels, and the first two are mounted as above. The third panel is then secured to the second panel by a single hinged element, secured to the back side of the two panels along the cut edge, with the same narrow gap being provided between the panels. Again, the color of the hinge element is chosen to minimize its visibility.

In the preferred embodiment of the invention, the panoramic picture is printed to the edge of the photographic paper on all sides, so that no border is present. Further, color photography techniques will be employed. With the method of the invention panoramic pictures can be mounted in an album of conventional size, and they present a most pleasing appearance when opened for display. By properly spacing the panels apart, the cut edges thereof will not be damaged in repeated use of the album, and by choosing the proper color tone for the hinge members and elements, the gaps between the panels will be barely noticeable.

It is the principal object of the invention to produce a construction and method for making a panoramic photograph album, whereby a double-wide photograph can be presented in an album of normal size in an attractive manner, and without damage thereto during opening and closing of the album.

Another object of the invention is to provide a construction and method for making a three-panel panoramic album display.

A further object is to provide a method for mounting a pair of photographic panels in side-by-side relationship to form the impression of a single, panoramic picture.

Other objects and many of the attendant advantages of the invention will become readily apparent from the following Description of the Preferred Embodiments, when taken in conjunction with the accompanying drawings.

DESCRIPTION OF THE PREFERRED EMBODIMENTS

Figure 2:
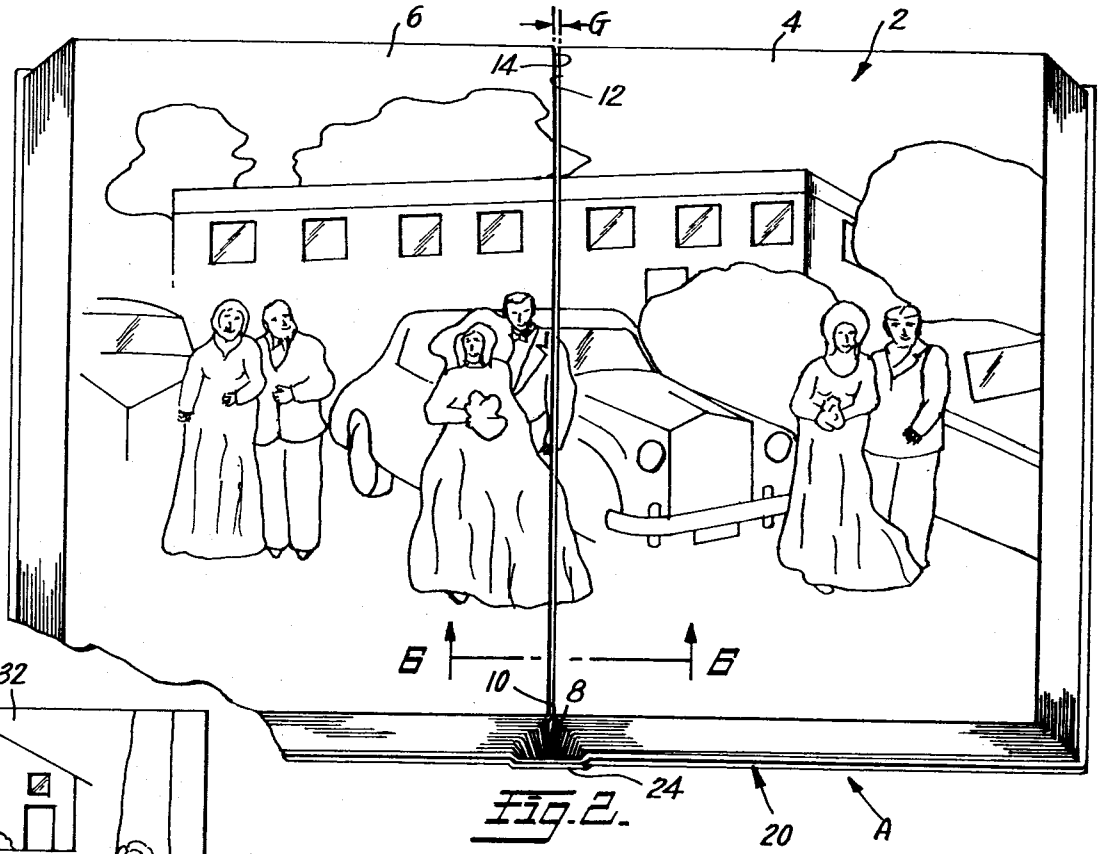
FIG. 2 is a plan view of a photograph album with the panoramic print of FIG. 1 mounted therein, and shows the narrow gap provided between the two panels of the photograph.

Referring now to the drawings, a panoramic double-wide photographic print is shown at 2. The print 2 is prepared by first having a photographer take a picture, to produce a negative with a panoramic image thereon. The photograph can be taken with any desired camera, although a camera with a wide-angle lens is especially useful. In taking the panoramic picture, it is preferable to have objects grouped toward the center to produce a so-called busy effect. This will help to make the gap in the mounted panoramic picture less visible.

It should also be noted that the panoramic picture 2 is preferably printed so that there is no border therearound. That is, the image is taken to the edge of the photographic paper, all the way therearound. This again improves the appearance of the completed mounted panoramic display.

The print 2 is first cut into two equal size portions or panels 4 and 6, along a cutting line C that extends at a right angle to the longitudinal axis of the picture, running horizontally thereacross. The two panels 4 and 6 are then ready for mounting.

Figure 5:
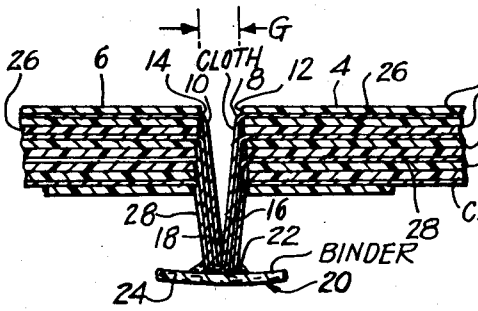
FIG. 5 is a fragmentary, cross-sectional view taken on line 5—5 of FIG. 2, and showing the arrangement of the hinge members and the picture panels.

Referring now to FIG. 5, the panels 4 and 6 are fastened to two hinge members 8 and 10. While the hinge members 8 and 10 can assume different constructions, the preferable construction therefor is that each member is a single piece of fine cotton mounting cloth, of a size to underlie the entire panel 4 or 6. The outer portion of each hinge member 8 and 10 is secured to the backside of its respective panel 4 or 6 along the cut edges 12 or 14 thereof, using a resin glue, or other suitable adhesive. As shown in FIG. 5, the hinge members 8 and 10 are fastened to the backside of the panels completely out to the cut edges 12 and 14 thereof.

The inner portions 16 and 18 of the hinge members 8 and 10 are then secured to the binding edge of an album binder 20. As shown in FIG. 5, in the preferred embodiment of the invention this securement is accomplished by simply using glue 22 to permanently attach the hinge members 8 and 10 to the spine 24 of the binder 20. In other kinds of albums, the inner portions 16 and 18 can be clamped between two clamping surfaces, or they might be secured by a set of binding posts passed therethrough. In any case, the hinge members 8 and 10 are secured so that the two panels 4 and 6 become facing pages mounted within the binder 20 of the photograph album A.

As is evident in FIGS. 2 and 5, the album binder 20 will normally contain a number of other pictures 26, mounted on hinge members 28 like the hinge members 8 and 10. Together, all of the pictures comprise the photograph album A, which can be opened to any selected location. When the album A is opened to the facing panels 4 and 6, the viewer will see a panoramic picture of unusually attractive appearance.

The panels 4 and 6 should ideally be mounted so that there is no gap therebetween when the album A is opened thereto. However, it has been found that this arrangement results in the cut edges 12 and 14 of the two panels rubbing against each other during opening and closing of the album, so that over time the panoramic picture is damaged along the cutting line. The result is most unattractive.

To solve this problem, a narrow gap G must be left between the two panels 4 and 6, say about $\frac{1}{8}$ of an inch. A gap of this width eliminates the problem of picture damage, but can be noticeable to such an extent that it disrupts the appearance of the panoramic picture.

In order to solve this appearance problem, the invention includes choosing the color tone of the hinge members 8 and 10 so that such will generally match the color tone of the central portion of the picture. Commonly, such hinge members 8 and 10 in an album will be of white cloth, but such has been found to be unsuitable for a panoramic picture. It presents a stark, white bar across the middle of the picture that emphasizes the separate panels 4 and 6.

It has been found that a dark brown color tone is nearly universally acceptable for the hinge members 8 and 10, when color photography is employed. This color tends to blend into the background of most photographs, and is barely noticeable. By composing the picture so that several different objects are located centrally of the double-wide picture, as is done in the print 2 shown in FIG. 1, further camouflage of the gap G occurs. The combination of a busy color photograph with hinge members 8 and 10 of a dark brown color tone produces a panoramic scene in which the gap G is usually not even perceived by the viewer.

While a dark brown color tone for the hinge elements 8 and 10 has been found nearly ideal, it is again noted that this color can be varied, to suit the particular needs of a given photographic print. The important thing is to match the color to the print, to minimize the visibility of the necessary gap G, with white and similar very light colors being generally unacceptable.

Returning to the hinge members 8 and 10, while such are illustrated as sheets of cloth which totally underlie the panels 4 and 6, it is to be understood that such could extend for only a short distance inwardly from the cut edges 12 and 14, if so desired. A problem with this arrangement, however, is that it tends to leave a bump under the photographic paper along the edges 12 and 14, which is sometimes visible and thus distracts from the quality of the panoramic photograph. Thus, the use of hinge members 8 and 10 that fully underlie the panels 4 and 6 is more desirable.

it is to be understood that while cotton cloth is preferred for the hinge members 8 and 10, other materials can also be utilized therefor. For example, the hinge members might be made of plastic, or even paper. However, cotton cloth has been found to be very effective.

Finally, the adhesive used to secure the panels 4 and 6 to their respective hinge members is a matter of choice, except that it is necessary for the panels to be permanently attached completely around their periphery, and the chosen adhesive should achieve this end. In place of resin glue, conventional heat-sensitive photographic mounting paper might be employed, or the like.

Figure 1:
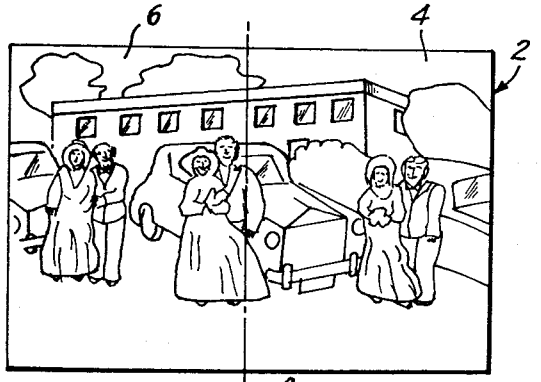
FIG. 1 is a plan view of a double-wide panoramic photographic print, prepared according to the invention.
Figure 3:
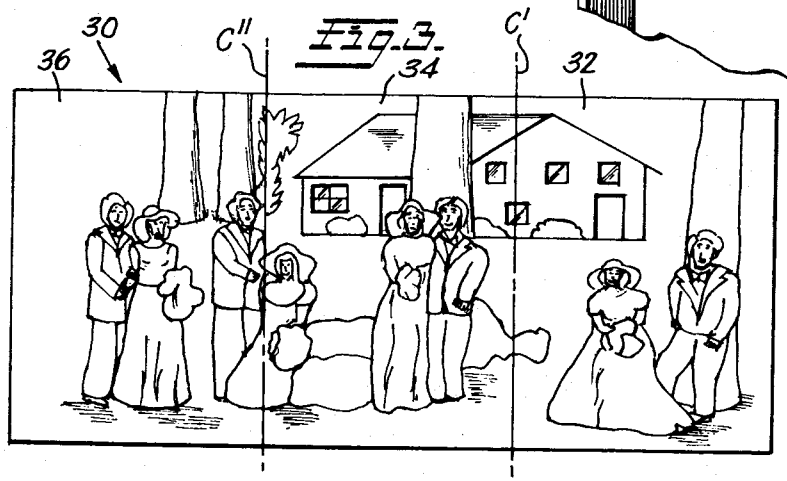
FIG. 3 is a view similar to FIG. 1, but showing a triple-wide panoramic picture, divided into three panels of equal size.
Figure 4:
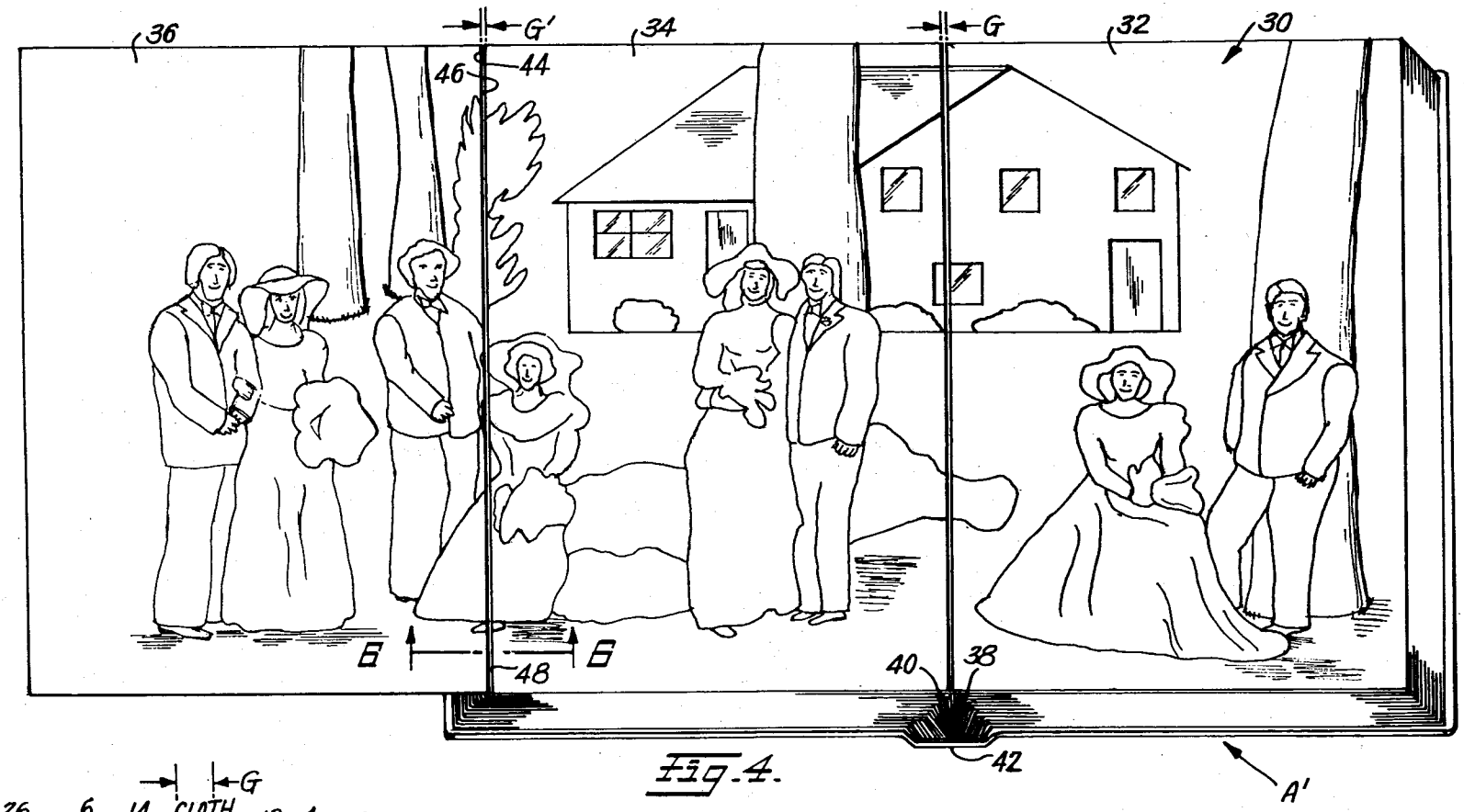
FIG. 4 is a plan view of a photograph album with the triple-wide print of FIG. 3 mounted therein.
Figure 6:
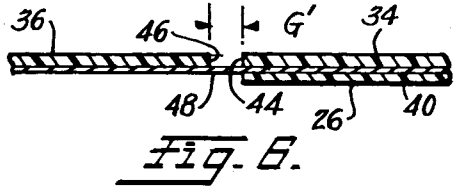
FIG. 6 is a fragmentary, cross-sectional view taken along the line 6—6 of FIG. 4, showing the hinge arrangement for connecting the third panel with the second panel.

Turning now to FIGS. 3, 4 and 6, a triple-wide photographic print is indicated generally at 30, and is divided into three panels 32, 34 and 36 of equal size, along cutting lines C′ and C″. The first two panels 32 and 34 have hinge members 38 and 40 attached thereto, which in turn are secured by glue to the spine 42 of an album A′, in the same manner as the panels 4 and 6 of FIGS. 1, 2 and 5 are mounted.

The third panel 36 is connected to the second panel 34, with the cut edges 44 and 46, respectively, thereof being spaced apart by a gap G' of a width like that of the gap G. A hinge element 48 is utilized to connect the second and third panels 34 and 36, and such is preferably formed as an integral extension of the hinge member 40, and fully underlies the third panel 36. The backside of the third panel 36 is fastened to its hinge element 48 by resin glue or the like, and the element 48 is of course similarly fastened to the backside of the second panel 34.

The connection between the second and third panels 34 and 36 functions similarly to the connection between the first and second panels 32 and 34, with the gap G' assuring that no damage will occur to the cut edges 44 and 46 when the panoramic picture is folded, and with the color of the hinge element 48 being dark brown, or otherwise selected to match the general tone of the region along the cutting line C''.

The album A or A' produced by the invention is most attractive insofar as the panoramic photographs mounted therein are concerned. Obviously, more than one panoramic photograph can be mounted in an album, and indeed the entire album can consist of such, if desired. Referring again to the drawings, it will be noted that pictures 26 are normally mounted on both sides of the hing members, the number of hinge members in the album determining the number of photographs that can be mounted.

The method for producing the album of the invention solves the problem of properly and attractively presenting double-wide, and wider, panoramic views in a conventional photograph album. To recapitulate, the method of the invention includes the following steps.

First, the photographer takes a panoramic picture, to produce a negative with a panoramic image thereon. Preferably, the picture is composed so that the central portion of the picture where the cutting line will lie is filled with different objects of varying color, preferably of a general dark tone.

The next step of the method is to print a panoramic photograph on a single piece of double-wide, or wider if necessary, photographic paper, preferably with no borders therearound. It is emphasized that the use of a single piece of paper to print the picture is important, as it has been found this produces superior results to printing on two separate sheets of photographic paper mounted in side-by-side relationship. It has been found that in the latter case, after processing the resultant prints do not always match up fully, due to paper shrinkage and the like. All of these problems are eliminated by printing on a single sheet of paper, and precisely matched panels are assured.

The third step of the method is to cut the single panoramic print into panels. If the print is double-wide, two panels are made. If triple-wide, three panels, and indeed the print can be made wider if desired, to the limits of the negative and the size of available photographic paper. In each case the print is separated into panels along a cutting line that extends perpendicular to the longitudinal, horizontal axis of the picture. This relationship is important, in that it assures panels that will fit properly into an album, and which can be opened and closed without causing damage thereto.

The next step of the method involves fastening hinge members to the backsides of the panels, along their cut edges. As noted, this can be done in different ways.

Finally, the inner ends of the hinge members are secured to the binding edge of an album, in a suitable manner. The fastening and securement of the hinge members, however, must be carried out so that a narrow gap of about ⅛ of an inch is present between the panels when the album is open, for the reasons that have been described.

If a third panel is present, it is secured to the second panel, using a hinge element that is preferably an extension of the hinge element utilized to mount the second panel. Again, a narrow gap is placed between the second and third panels, to provide for folding of the panels without causing damage to the photographs.

An album construction and method have been shown and described which fulfill all of the objects set forth for the invention. Obviously, variations and modifications of the invention are possible, within the teachings herein presented.

What is claimed is:

1. The method for making a double-wide panoramic photographic print and mounting it into a single-wide photograph album so that it can be displayed lying in a flat plane, said album including a binding edge, and said method including the steps of:

taking a panoramic picture, to produce a negative with a panoramic image thereon which extends horizontally substantially beyond what can be accommodated upon a single-wide sheet of photographic paper;

printing the negative on a single, integral sheet of double-wide photographic paper to produce an elongated, planar panoramic print;

cutting the integrally printed panoramic planar print into two print portions along a cutting line extending at a right angle to the longitudinal axis of the print and forming two planar panels each carrying thereon one of said portions of said print, said cutting line forming matting edges for the two print portions;

selecting separate, flexible hinge members for each of said planar panels, chosen so that the color tone of said hinge members is dark and generally blends with the color tones in the center portion of said panoramic print along said cutting line, each hinge member including a planar outer portion and an inner portion, separated by a transverse hinge portion;

fastening the planar outer portions of said separate, flexible hinge members with adhesive means to the rear sides of the two planar panels along the cut, mating edges of said two print portions, whereby a hinge line is formed immediately adjacent each of said mating edges by said transverse hinge portion; and securing the inner portions of said separate, flexible hinge members to the said binding edge of said photograph album along a securing line spaced from said hinge lines, whereby to mount said two planar panels so they can be moved between a closed position wherein they are in face-to-face abutment and an open position wherein the panels are presented in side-by-side relationship along said print cutting line, so that said panels lie in a common plane and display the panoramic image;

said separate, flexible hinge members being fastened and secured to provide a narrow gap between said hinge lines and said immediately adjacent cut, mating edges of said print portions when said planar panels are lying in said common plane in said open position, whereby said panels can be pivoted between said closed and said open positions without said cut, mating print portion edges coming into damaging engagement with each other.

2. The method as recited in claim 1, wherein said hinge members underlie the full extent of said panels, and said fastening step includes fastening the entire backsides of said panels to said hinge members.

3. The method as recited in claim 1, wherein said panoramic picture is taken so that a grouping of objects occurs near the center thereof, where said cutting line occurs.

4. The method as recited in claim 1, wherein said print is triple-wide, and wherein said cutting step includes cutting said print into three print portions along parallel cutting lines and forming three planar panels, the first and second of said planar panels being secured to the binding edge of said photograph album, and including the further steps of:

fastening a separate, flexible hinge element to the backsides of the second and third of said planar panels, to connect said third panel with said second panel, said hinge element being fastened to said second and third panels, whereby said panels can lie in a common plane with a narrow gap therebetween to provide for folding and unfolding of said third panel on said second panel without damaging the print portion on either panel.

* * * * *